US006213107B1

(12) United States Patent
Gyllenstedt

(10) Patent No.: US 6,213,107 B1
(45) Date of Patent: Apr. 10, 2001

(54) CRANKCASE VENTILATION IN AN INTERNAL COMBUSTION ENGINE

(75) Inventor: Jan Gyllenstedt, Kungalv (SE)

(73) Assignee: Volvo Lastvagnar AB, Gothenburg (SE)

( * ) Notice: Subject to any disclaimer, the term of this patent is extended or adjusted under 35 U.S.C. 154(b) by 0 days.

(21) Appl. No.: 09/403,981

(22) PCT Filed: Apr. 29, 1998

(86) PCT No.: PCT/SE98/00793

§ 371 Date: Dec. 3, 1999

§ 102(e) Date: Dec. 3, 1999

(87) PCT Pub. No.: WO98/49432

PCT Pub. Date: Nov. 5, 1998

(30) Foreign Application Priority Data

Apr. 29, 1997 (SE) ..... 9701611-7

(51) Int. Cl.[7] ..... F02B 25/06

(52) U.S. Cl. ..... 123/572

(58) Field of Search ..... 123/572, 573, 123/574

(56) References Cited

U.S. PATENT DOCUMENTS

| | | | | |
|---|---|---|---|---|
| 1,872,609 | | 8/1932 | Schittke . | |
| 5,937,836 | * | 8/1999 | Yonezawa et al. | 123/572 |
| 6,029,638 | * | 2/2000 | Funai et al. | 123/572 |

FOREIGN PATENT DOCUMENTS

| | | |
|---|---|---|
| 423 791 | 1/1926 | (DE) . |
| 2 103 061 | 8/1971 | (DE) . |
| 0 736 673 | 10/1996 | (EP) . |
| 1 014 746 | 12/1965 | (GB) . |

* cited by examiner

*Primary Examiner*—Marguerite McMahon
(74) *Attorney, Agent, or Firm*—Young & Thompson

(57) ABSTRACT

Internal combustion engine with crankcase ventilation, having an outlet (13) placed to one side of an existing rotating wheel or gear (3) in a drive train (3, 4, 5), so that the wheel or gear, through its centrifugal effect, separates oil drops from the oil mist in the blow-by gas adjacent the outlet.

7 Claims, 1 Drawing Sheet

CRANKCASE VENTILATION IN AN INTERNAL COMBUSTION ENGINE

Figure 1:
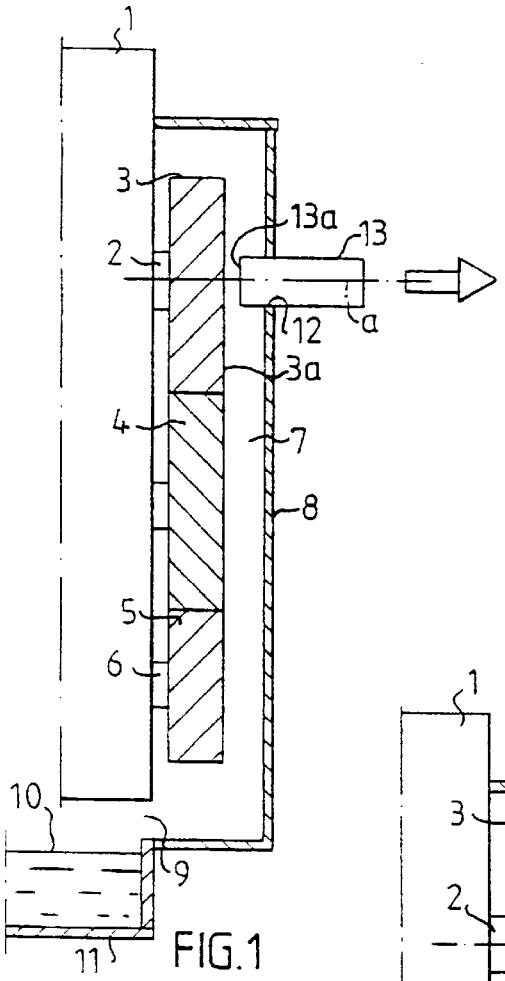

The present invention relates to an internal combustion engine with a crankcase containing oil, a ventilation arrangement for evacuating blow-by gases from the crankcase and a wheel rotating when the engine operates, said wheel being enclosed in a space which communicates with the crankcase.

It is a known fact that it is not possible that the piston rings between the pistons in the surrounding cylinder walls of the cylinders in an internal combustion engine will achieve a one hundred percent seal between the combustion chambers and the engine crankcase. A small amount of combustion gases, so-called blow-by gases, always slip past the piston rings and flow down into the engine crankcase. In order to prevent excessive overpressure due to the blow-by gases in the crankcase, the crankcase must be ventilated by venting the gases away, leaving only a small over-pressure in the crankcase.

There are two types of crankcase ventilation, viz. open and closed ventilation. An engine with open ventilation can quite simply have, in the valve cover for example, a downwardly directed pipe, which is connected to an opening in the engine and which opens into the surrounding atmosphere. In an engine with closed crankcase ventilation, the blow-by gases are conducted from the crankcase to the engine intake manifold and are mixed with the intake air.

When evacuating blow-by gases from the crankcase it has hitherto been unavoidable that a certain amount of oil mist will accompany the blow-by gases. The amount of oil accompanying the blow-by gases depends on the placement of the ventilation outlet and on any filters or oil traps used in the crankcase ventilation. Regardless of whether the engine has open or closed crankcase ventilation, it is desirable to keep the amount of oil in the evacuated blow-by gases to a minimum.

In the former case, the negative environmental impact is to be kept as small as possible, and the engine oil consumption is to be minimized. In the latter case, it is intended to prevent oil coating or deposits on the components of the engine intake system, for example, oil coating on the blades of the compressor of a turbo-charged engine or oil deposits in the charge air-cooler in engines with charge air-cooling.

The purpose of the present invention is to achieve an engine of the type described by way of introduction, in which the amount of oil mist evacuated with the blow-by gases via crankcase ventilation is very small.

This is achieved according to the invention by virtue of the fact that the ventilation arrangement comprises an outlet from said space, said outlet being disposed to one side of a lateral surface of the rotating wheel and with at least the major portion thereof within the periphery of the wheel.

In a preferred embodiment of the engine according to the invention, a highly placed gear in the engine camshaft drive train is used. The outlet, in the form of a short pipe is preferably fixed in an opening in the drive train casing directly opposite the center of the gear.

It has been found that the rotating gear to one side of the outlet has such a centrifugal effect that practically all of the oil mist can be separated from the blow-by gases in the vicinity of the outlet. For example, comparative trials when driving under extreme conditions and extraction of excess power in a test rig revealed that an engine with conventional open crankcase ventilation emitted a large amount of oil in one 24 hour period, while the same engine with the ventilation arrangement according to the invention mounted, reduced the amount of oil emitted by more than 99%. In other words, practically one hundred percent separation of oil from the evacuated blow-by gas was achieved.

Figure 2B:
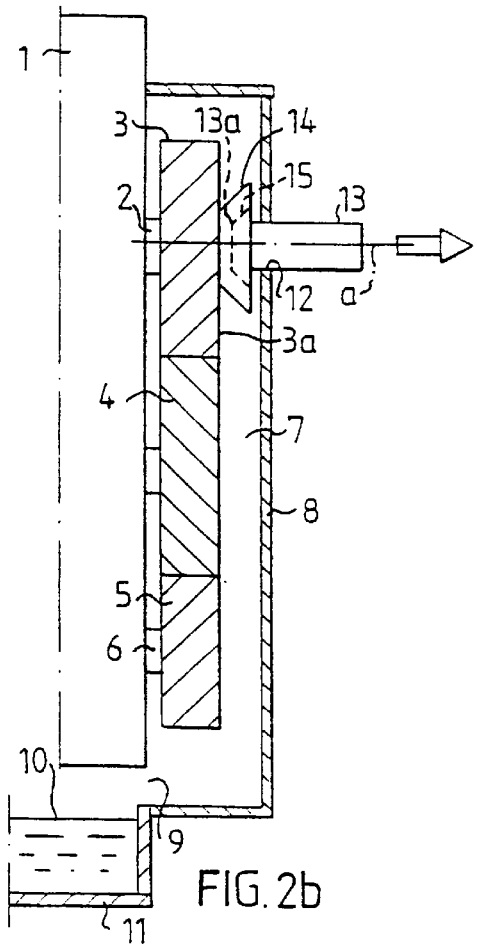
Figure 2A:
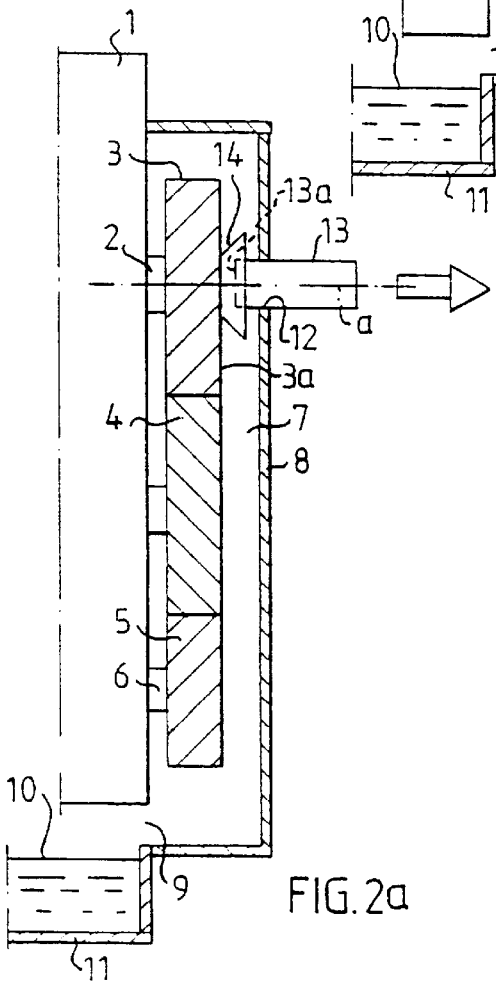

The invention will be described in more detail below with reference to examples shown in the accompanying drawing, where FIG. 1 shows schematically and in longitudinal section one embodiment of the front end of an internal combustion engine according to the invention, FIG. 2*a* shows a view corresponding to FIG. 1 of a second embodiment of an engine according to the invention, and FIG. 2*b* shows a view corresponding to FIG. 1 of a third embodiment of an engine according to the invention.

In the figures, 1 designates the front end of an engine with an over-head camshaft, at the front end 2 of which a gear 3 is fixed, which via an intermediate gear 4 is driven by a gear 5 on the front end 6 of the engine crankshaft. The camshaft drive train formed by the gears 2, 3, 4 and 5 is enclosed in a space 7 which is sealed by a drive train casing 8 and which, via one or more openings 9, communicates with the crankcase 10 of the engine, which is sealed below by an oil sump 11 containing oil.

In an opening 12 in the drive train casing 8, a short pipe 13 is fixed with its center axis 14 in line with the rotational axis of the gear 3 and with its inner end 13*a* at a distance from the lateral surface 3*a* of the gear 3, which in the shown embodiment examples, is substantially less than the diameter of the gear. Tests performed have demonstrated that this distance should be less than the gear diameter to provide optimum effect. The short pipe 13 is preferably connected via a conduit to the engine intake conduit (not shown). As the gear 3 rotates, the centrifugal force will cause the oil drops in the oil mist in the space between the pipe end 13*a* and the lateral surface 3*a* of the gear 3 to be thrown out towards the periphery of the gear. It has been demonstrated that in this simple manner it is possible to separate such a large amount of oil from the blow-by gases between the gear 3 and the pipe end, that the percentage of oil which is carried out of the crankcase with the blow-by gases will amount to less than 10% of the amount of oil taken out when the crankcase 10 is ventilated via, for example, an outlet in the engine valve casing.

In order to further increase the centrifugal pumping action of the gear 3 and its ability to separate oil from the blow-by gas in the gap between the gear and the pipe end 13*a*, the gear 3 can be provided with a barrier 14, as is shown in FIGS. 2*a* and 2*b*. The barrier 14 can possibly be provided with small vanes (not shown) on its outer surface. Even the pipe end 13*a* can be provided with a barrier 15, as shown in FIG. 2*b*.

It has been demonstrated that by optimum exploitation of the inventive principle, it is possible to separate out more than 99% of the oil which was previously lost with the blow-by gases, ventilated out via the flywheel casing or the valve casing.

The invention is, of course, not limited to using existing drive train gears. Alternatively, the outlet, if this should prove more advantageous, can be placed near a rotating wheel which is specially designed for and is only intended for centrifugal separation of oil drops from the blow-by gases closest to the outlet. Nor is it necessary that the outlet pipe 13 be disposed directly opposite the center of the rotating centrifugal wheel and it does not need to be directed perpendicular to the lateral surface 3*a* of the wheel, even if this in most cases provides the optimum separation effect. Depending on the design of the engine and available space, it can be necessary to dispose the outlet 13 closer to the periphery of the rotating wheel 3 and possibly also to incline the outlet pipe relative to the wheel side 3*a*. When displacing the outlet towards the periphery of the wheel, it is important to see to it that at least the major portion of the cross-sectional outlet is within the periphery of the wheel, to avoid the wheel throwing oil towards the outlet.

What is claimed is:

1. Internal combustion engine with a crankcase containing oil, a ventilation arrangement for evacuating blow-by gases from the crankcase and a transmission wheel rotating when the engine operates, said transmission wheel being enclosed in a space which communicates with the crankcase, wherein the ventilation arrangement comprises an outlet (13) from said space (7), said outlet being disposed to one side of a lateral surface (3*a*) of a rotating wheel (3) and with at least the major portion thereof within the periphery of the wheel, characterized in that the outlet is pointing directly towards the center of said transmission wheel.

2. Engine according to claim 1, characterized in that the wheel (3) is a gear.

3. Engine according to claim 1, characterized in that the outlet (13*a*) is placed so that its distance to the lateral surface (3*a*) of the rotating wheel (3) is less than the diameter of the wheel.

4. Engine according to claim 1, characterized in that the outlet (13) for the blow-by gases of the crankcase (10) opens into a conduit, which communicates with an intake air conduit of the engine.

5. Engine according to claim 1, characterized in that the gear (3) is part of a camshaft drive train (3,4,5) and that the outlet (13) extends through an opening (12) in a drive train casing.

6. Engine according to claim 2, characterized in that the gear is one of the upper gears (3) in a drive train with upper and lower gears (4,5).

7. Engine according to claim 1, characterized in that the wheel and the outlet are coaxial.

* * * * *